United States Patent [19]

Leonhart

[11] 4,270,648

[45] Jun. 2, 1981

[54] COIN OPERATING MECHANISM PROVIDING CONTROLLED PLAY OF MULTIPLE GAMES FROM A SINGLE COIN

[76] Inventor: Xaver F. Leonhart, 8381 Harburg, near 8385 Pilsting/Ndb., Del.X

[21] Appl. No.: 94,359

[22] Filed: Nov. 15, 1979

[30] Foreign Application Priority Data

Nov. 16, 1978 [DE] Fed. Rep. of Germany ..... 2849647

[51] Int. Cl.[3] ..... G07F 5/22

[52] U.S. Cl. ..... 194/1 C; 194/1 J

[58] Field of Search ..... 194/9, 1 C, 1 D, 9 T, 194/10, 1 G, 1 Q, 1 K, 1 J, 1 M

[56] References Cited

U.S. PATENT DOCUMENTS

| | | | |
|---|---|---|---|
| 2,665,791 | 1/1954 | Caruso | 194/9 R |
| 3,154,182 | 10/1964 | Eickhoff | 194/1 J |

*Primary Examiner*—Stanley H. Tollberg

*Attorney, Agent, or Firm*—Brady, O'Boyle & Gates

[57] ABSTRACT

Switches corresponding in number to the number of games to be played on a coin operated machine by a single coin are spaced from each other along a coin channel with an operator arm for each switch extending through a longitudinal slit in the channel side wall into the path of travel of a coin in the channel, and a selectively pivotal coin support lever extending through a longitudinal slit in the opposite side wall into the coin channel adjacent each switch except the first switch. A coin discharge channel is positioned above each coin support lever a distance so its bottom wall is tangent to or an extension of the circumference of a first coin on the coin support lever whereby a second coin inserted while the first coin is still in the coin channel on the coin support arm is deflected by the edge of the first coin into the coin discharge channel to avoid its interference with the switches.

10 Claims, 3 Drawing Figures

COIN OPERATING MECHANISM PROVIDING CONTROLLED PLAY OF MULTIPLE GAMES FROM A SINGLE COIN

FIELD OF THE INVENTION

The invention is directed to an auxiliary device, designed for use on coin scanning mechanisms to provide a coin operating mechanism for coin operated machines, games, and the like, which device has microswitches in the coin channel, that makes it possible to provide several games while preventing the coins that still happen to be inside the game, or that are inserted subsequently, from subverting the switching process from one game to another.

DESCRIPTION OF THE PRIOR ART

Prior art devices provide a coin channel, located behind the coin scanning mechanism, with a microswitch whose spring-mounted control lever projects across the coin channel through a continuous longitudinal slit therein and that swings into its operative position under the impact of an inserted coin. Difficulties arise when the coin is intended to provide the play of several consecutive games on the same machine. In that case the microswitch is used to trigger the step-by-step switch which, in turn, makes available the required number of games one by one on the coin operated game. But even if the step-by-step switch is not made dependent on a time lapse that can be set in advance, the player is allowed to start the next game by pressing a specific button, the danger still persists that a player may interrupt a game for whatever reason and that the step-by-step switch remains blocked in an intermediate position and springs back when a subseqeunt coin is inserted with the first coin still in the coin channel, and it can only be brought back to its neutral position by the player. Furthermore, the power can remain switched on in that intermediate position of the step-by-step switch, in particular with machines that are located in the open, so that therein provided batteries become useless within a short perior of time.

SUMMARY OF THE INVENTION

The invention is based on the need to eliminate this disadvantage in a simple manner and to ensure at the same time that the microswitch does not remain switched on continuously, because of the insertion of more than one coin, and that thus a continuous game without payment is not made possible.

The problem is solved through this invention by providing a long coin channel with several microswitches spaced over a specific distance along the length thereof, whose number corresponds to the number of games to be played that are provided for by one coin, and whose springy switch levers project through a longitudinal slit in the side wall of the coin channel provided for each switch, and one coin support lever each that projects through the upper part of the slit (except for the uppermost slit) and that can be moved out of the slot, and that supports an inserted coin sideways (at right angles thereto) so that the coin partly tips or rolls sideways into a lateral widening portion of the coin channel, as well as one short channel each on the other side of the coin channel, whose lower edge is in registration with the circumference of the first coin in the coin channel so as to constitute an extension of the circumference of the sideways tipped first coin, so that a newly inserted second coin, deflected by the edge of the tipped first coin, drops through the short channel and then into a coin box, so that it cannot remain in the coin channel to maintain a microswitch in an actuated position.

BRIEF DESCRIPTION OF THE DRAWINGS

The drawings represent, by way of example, a prior art coin scanning mechanism with the auxiliary device according to the invention mounted thereon, in which.

DESCRIPTION OF THE PREFERRED EMBODIMENT

Figures 1, 3:
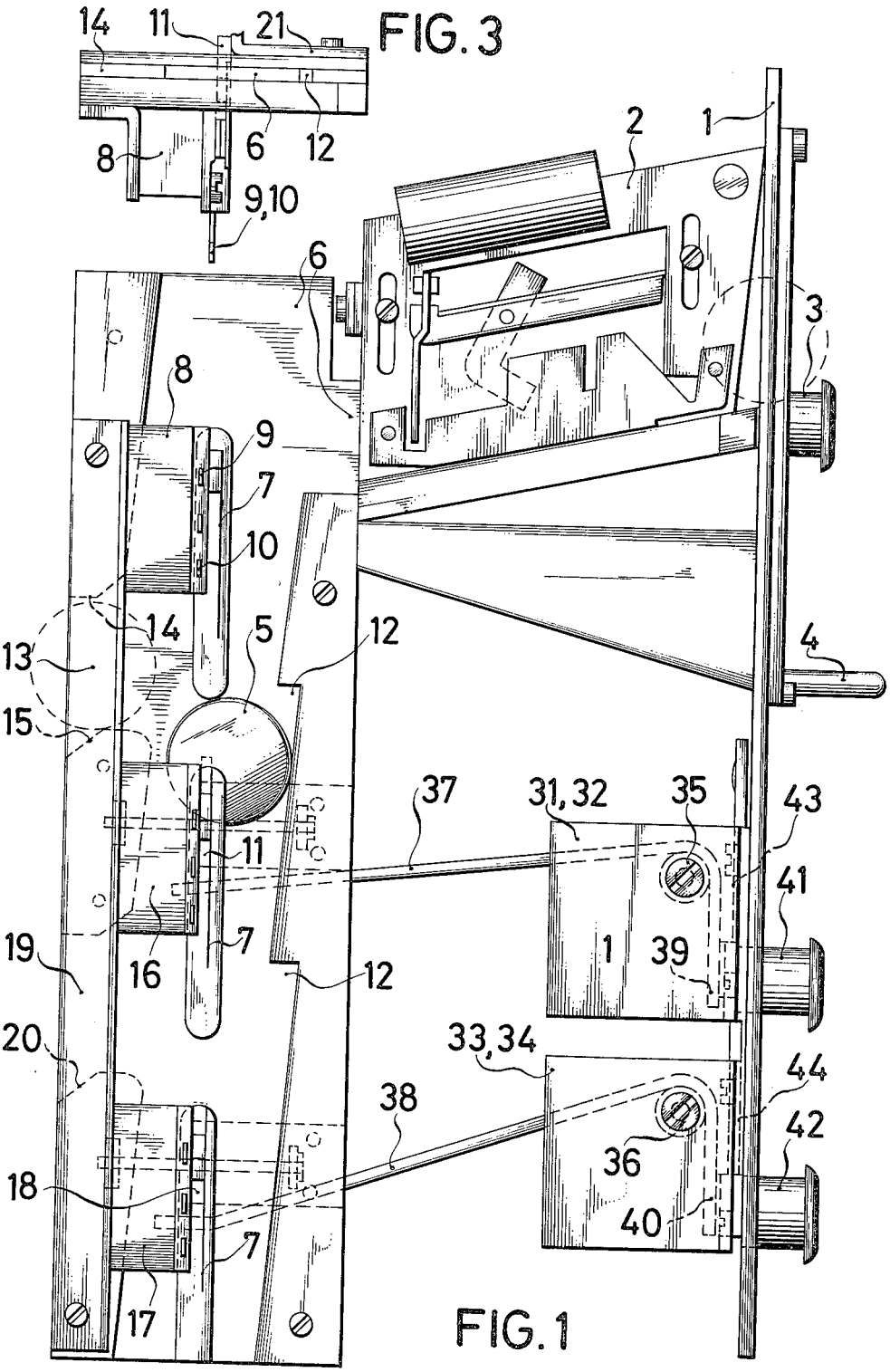
FIG. 1 is a side elevation view (from the left) of a coin scanning mechanism with the device according to the invention.
FIG. 3 is a top plan view of the auxiliary device according to the invention as shown in FIG. 1.

A coin scanning mechanism 2 of a type well known in the art, with refund button 3 and coin catch 4, is located behind front panel 1. When coin 5 is inserted and passes unimpaired through coin scanning mechanism 2, the coin drops into coin channel 6 of the device of the invention, and thereby moves switch lever 7 of microswitch 8 temporarily into its operative position so that electric current can pass through the circuit of the microswitch which includes soldering tabs 9 and 10 of the microswitch, and for instance through an electromagnet in circuit therewith that releases the game balls in a coin operated game.

According to the invention, coin 5 is retained by locking lever 11 positioned laterally relative to the center of gravity of the coin in such a way that the coin is moved forward toward the widening or wider portion 12, of the vertical portion of the coin channel 6. The coin support or locking lever 11 extends through a longitudinal slit in the side wall of coin channel 6, as shown in FIG. 1. If, in the position of coin 5, according to FIG. 1, a second coin were to be inserted, it would rest on top of the first coin shown in full lines and continuously maintain the switch lever 7 of microswitch 8 in its actuated position moved out of the path of the coin in the channel, and maintain microswitch 8 supplied with power and therefore, for instance, continuously maintain the release solenoid of a ball game in an upward position, so that an endless game would be possible. That is avoided in the present device by providing a short lateral channel 13 on one side of channel 6 that is formed by or between plates 14 and 15. Plate 15 is designed so that the second coin can drop out of the channel 6 along the upper end of the plate 15 and that switch lever arm 7 can return to its normal position across the channel 6, and microswitch 8 can return to its currentless or open circuit position. Underneath microswitch 8, spaced along the vertical length of channel 6, are two additional microswitches 16 and 17, as well as another locking lever 18 and another short lateral channel 19 that runs through the side of channel 6 between plates 15 and 20.

Locking levers 11 and 18 are pivotally mounted on small angle pieces 21 and 22 secured to the channel 6, so that they can rotate around axes 23 and 24, respectively. Springs 27 and 28, which latch onto pegs 25 and 26 on the locking levers 11 and 18, urge portions of the locking levers into engagement with notches 29 and 30 of angle pieces 21 and 22.

Furthermore, angle irons 31 to 34 with cylindrical rods 35 between pairs thereof, are provided on the back of front panel 1. Angled band irons 37 and 38 are soldered onto sleeves 36 that are positioned on the cylindrical rods 35. Band iron end portions 39 and 40, which are directed downward, can be moved away from the back of the front panel by push buttons 41 and 42, respectively, against the force of flat springs 43 and 44, whereby the free end of the longer leg portions 37 and 38 of the band irons are lifted or rotated upwardly, and locking levers 11 and 18 are contacted thereby and swiveled clockwise in FIG. 2 about pivot axes 23 and 24, out of the coin channel 6 against the force of springs 27 and 28.

When, for instance, button 41 is pushed in, then locking lever 11, driven by band iron end or leg portion 37, rotates around its axis 23 and frees the coin 5 so that it can now drop further in coin channel 6 into contact with locking lever 18, and in its travel turn on microswitch 16 by rotating its switch lever arm 7 as it passes through the channel in order to make the second game available.

Figure 2:
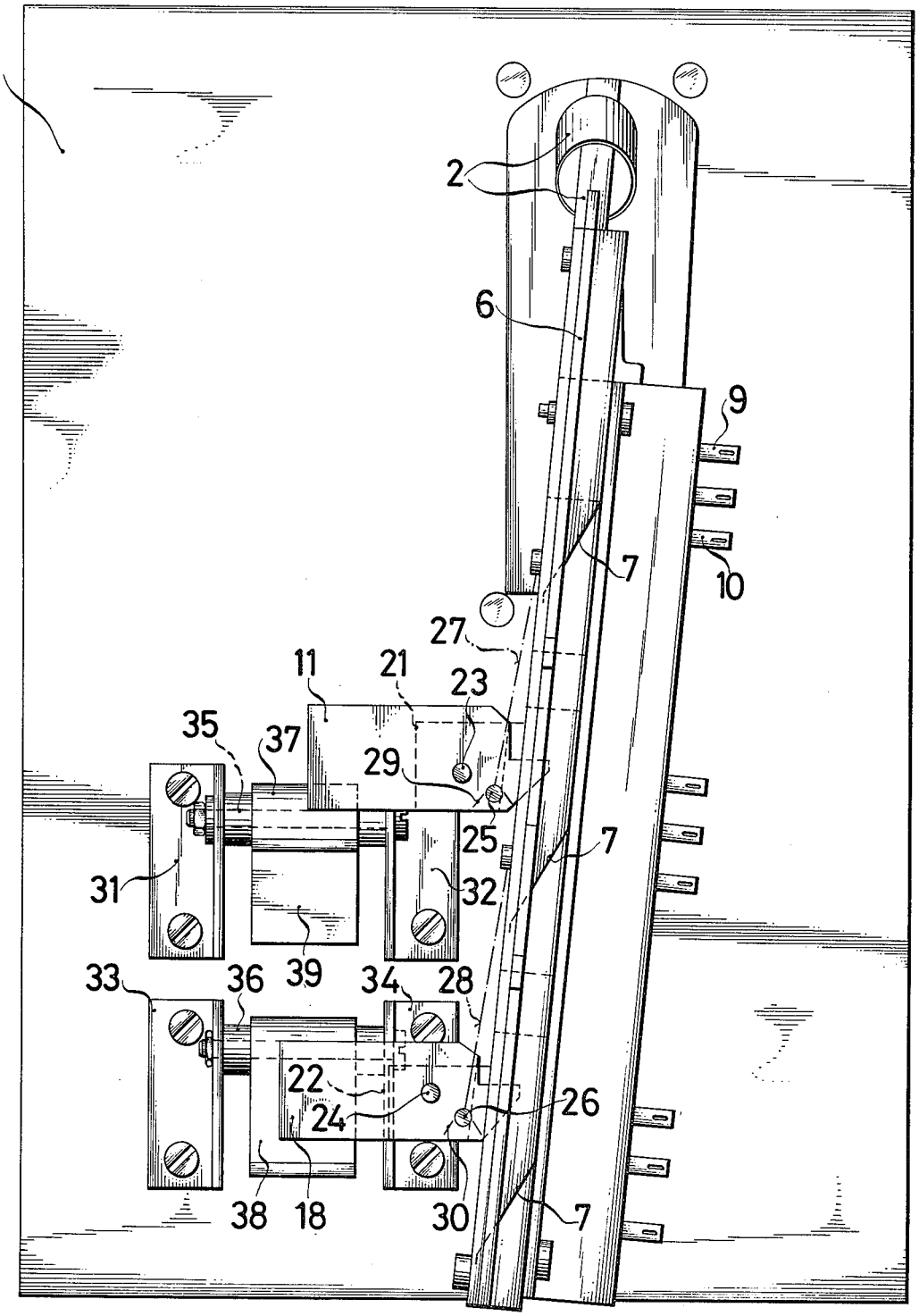
FIG. 2 is a rear elevation view thereof.

If button 42 is subsequently pushed in, then band iron end or leg portion 38 moves locking lever 18 clockwise, FIG. 2, and as it disengages from the coin channel it releases the coin supported thereby so that the coin as it drops further in channel 6 moves switch lever arm 7 of microswitch 17 and switches on the microswitch to complete the circuit for the third game, and then drops into the coin box, not shown, that is positioned beneath channel 6.

If a second coin is inserted intentionally or inadvertently, then it will be held back by either locking lever 11 or 18 if no coin is present there. However, the coin is released through short channels 13 or 19 into the coin box if a coin is already there. Thus when, for instance, a coin is already inside coin channel 6, as illustrated in full lines in FIG. 1, then a second coin will contact the circumference of the first coin and as illustrated in dotted lines, drop out through short channel 13 into the coin box. It will, however, switch on microswitch 8 before that, so that the first game is freed. If button 41 is pushed in after a game is over, then the second game will be readied by the already available coin 5, whereby coin 5 drops alongside and past microswitch 16 onto locking lever 18. The same process occurs if button 42 is depressed, so that every player has the required three games regardless whether a coin is already present inside the coin channel or not.

This solution not only replaces the expensive and very power-consuming step-by-step switch mechanism with the much less expensive microswitches, but it obtains the described advantages with the consumption of little electric power and is therefore also suitable for battery-powered machines.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. A coin operating mechanism for coin operated games and the like comprising, a coin channel (6) having side wall portions, end wall portions a top opening adapted to receive coin means and a bottom opening through which said coin means can be discharged, a plurality of switch means (8,16,17) spaced from each other along the length of said coin channel the number of which corresponds to the number of games provided by said coin means, said coin channel (6) having an opening through said side wall portions adjacent each of said switch means, a switch operator (7) for each of said switch means projecting through the corresponding opening into said coin channel into the path of travel of the coin means, a coin support lever (11,18) connected adjacent each switch means except for the uppermost switch means of said plurality of switch means, and projecting through the corresponding opening into said coin channel into the path of travel of the coin means and adapted to support the coin means sideways so the coin means tips toward one end wall portion (12) of the coin channel, said coin support lever (11,18) connected to pivot relative to said coin channel out of the corresponding opening, manually operable means (37 to 42) for each coin support lever (11,18) and operable to pivot the corresponding coin support lever out of said coin channel, and a coin discharge channel (13,19) through the other end wall portion of the coin channel (6) spaced above each coin support lever, each coin discharge channel (13,19) having a bottom wall (15,20) spaced above the corresponding coin support lever (11,18) by an amount such that the bottom wall constitutes an extension of the circumference of the sideways tipped coin means on the coin support lever, whereby a newly inserted coin is adapted to be deflected by the edge of the coin means on the coin support lever and directed through the coin discharge channel (13,19).

2. A coin operating mechanism as set forth in claim 1, in which said coin channel is relatively long and is disposed at an acute angle to the vertical.

3. A coin operating mechanism as set forth in claim 1, in which said switch operator for each of said switch means comprises a springy switch lever arm.

4. A coin operating mechanism as set forth in claim 1, in which the opening through said side wall portions comprise longitudinal slits through said side wall portions adjacent each of said switch means.

5. A coin operating mechanism as set forth in claim 1, in which said coin support lever (11,18) is positioned in said coin channel (6) above the switch operator (7) of the corresponding switch means (8,16,17).

6. A coin operating mechanism as set forth in claim 1, in which said coin channel (6) has a widened portion (12) beneath each of said switch operators (7).

7. A coin operating mechanism as set forth in claim 1, in which said switch means (8,16,17) and said coin support levers (11,18) are connected on opposite sides of said coin channel (6).

8. A coin operating mechanism as set forth in claim 7, in which said opening through said side wall portions comprise longitudinal slits through opposite side wall portions in substantial registration with each other, said coin support lever extending through the longitudinal slit in one side wall portion and said switch operator extending through the longitudinal slit in the opposite side wall portion.

9. A coin operating mechanism as set forth in claim 1, in which said coin support levers (11,18) project into said coin channel (6) at positions off-center of the path of travel of coin means in said coin channel.

10. A coin operating mechanism as set forth in claim 1, in which each of said manually operable means comprises a lever arm pivotally connected at substantially right angles to said coin support lever, means connected to pivot said lever arm into contact with said coin support lever to pivot the latter out of said coin channel.

* * * * *